United States Patent [19]

Luscomb

[11] 4,449,503

[45] May 22, 1984

[54] FUEL INJECTION PUMP

[75] Inventor: Douglas A. Luscomb, Mt. Upton, N.Y.

[73] Assignee: The Bendix Corporation, Southfield, Mich.

[21] Appl. No.: 421,606

[22] Filed: Sep. 22, 1982

Related U.S. Application Data

[63] Continuation-in-part of Ser. No. 276,608, Jun. 28, 1981, Pat. No. 4,422,424.

[51] Int. Cl.[3] ..... F02M 39/00

[52] U.S. Cl. ..... 123/447; 123/458; 123/459

[58] Field of Search ..... 123/447, 446, 445, 458, 123/459, 457, 501, 502

[56] References Cited

U.S. PATENT DOCUMENTS

| | | | |
|---|---|---|---|
| 1,974,851 | 9/1934 | Hurst | 123/459 |
| 3,547,092 | 12/1970 | Knight | 123/450 |
| 3,557,764 | 1/1971 | Knight | 123/447 |
| 3,587,547 | 6/1971 | Hussey et al. | 123/452 |
| 3,837,324 | 9/1974 | Links | 123/457 |
| 4,106,458 | 8/1978 | Kohler | 123/457 |
| 4,249,497 | 2/1981 | Eheim et al. | 123/446 |
| 4,275,693 | 6/1981 | Leckie | 123/447 |
| 4,343,280 | 8/1982 | Luscomb | 123/458 |

*Primary Examiner*—Ira S. Lazarus
*Assistant Examiner*—Magdalen Moy
*Attorney, Agent, or Firm*—Raymond J. Eifler; Thomas K. Ziegler

[57] ABSTRACT

A fuel injection pump (100) including a plunger (2) and a piston (1) movably disposed in a pumping chamber (17), means for initiating (3, 5) fuel injection and means for terminating (13, 20, 29) fuel injection, the plunger periodically pressurizing fuel in a pressure chamber (44) and the piston (1) spaced from the plunger and allowing a metering chamber (16) to fill with a metered quantity of fuel to be injected to an engine. The means for initiating injection comprises a pilot valve (5) having a solenoid to selectively operate between either of two states and a control valve (3) movable between first and second positions in response to the state of pilot valve (5), the first position filling the metering chamber (16) with the metered quantity of fuel. The pilot valve (5) determines the fuel quantity to be delivered to the engine relative to a signal from an electronic controller. An accumulator (4) is pressurized during each cycle of the plunger (2) to provide pressurized fuel during a metering phase. A variable orifice (15) adjusts the rate of flow during the time fuel is being metered to metering chamber (16).

6 Claims, 14 Drawing Figures

FIG. 2
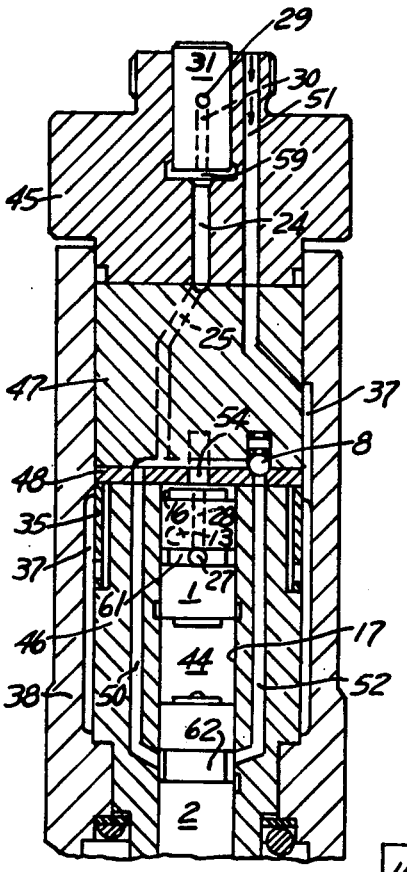
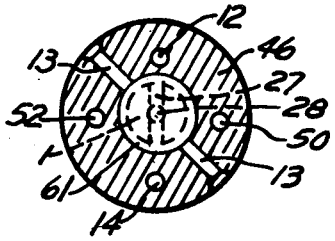
FIG. 4
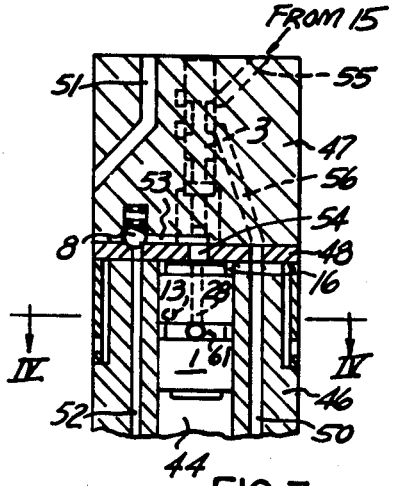
FIG. 3
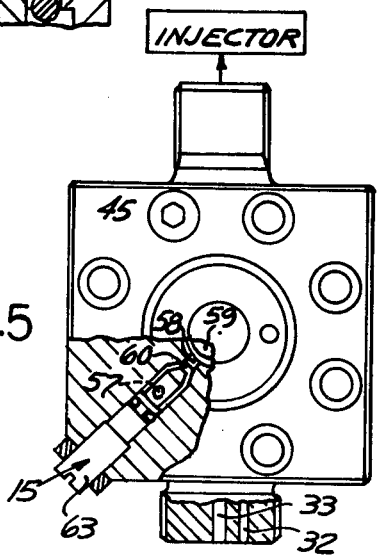
FIG. 5

DE-ENERGIZED

CONTROLLER/OPERATIONAL PHASES

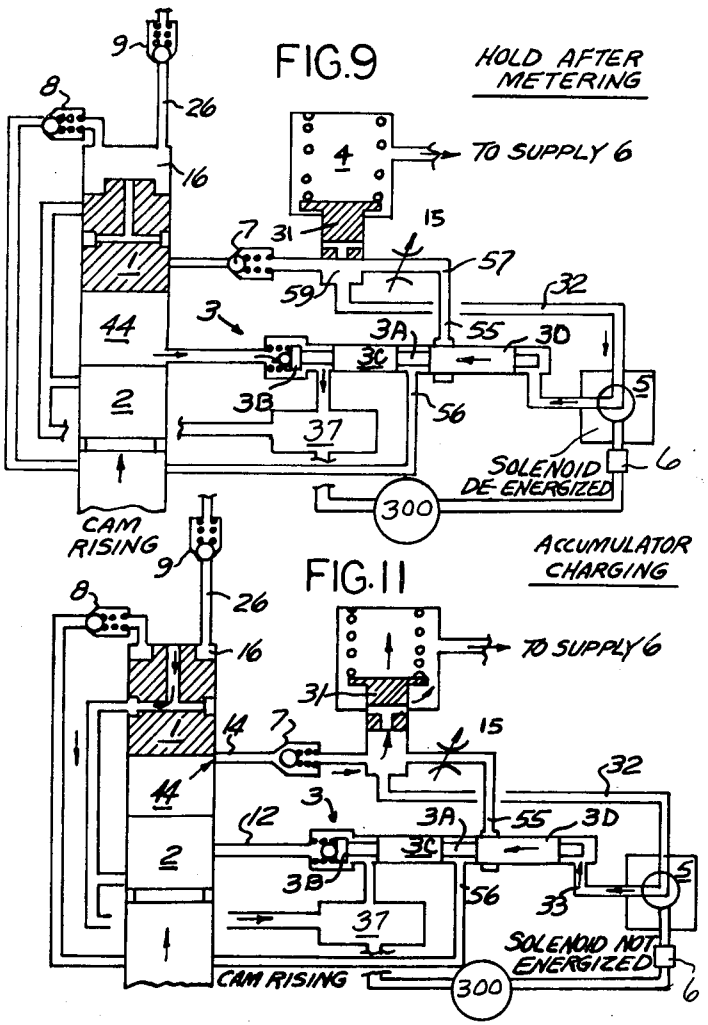
FIG.9
FIG.11
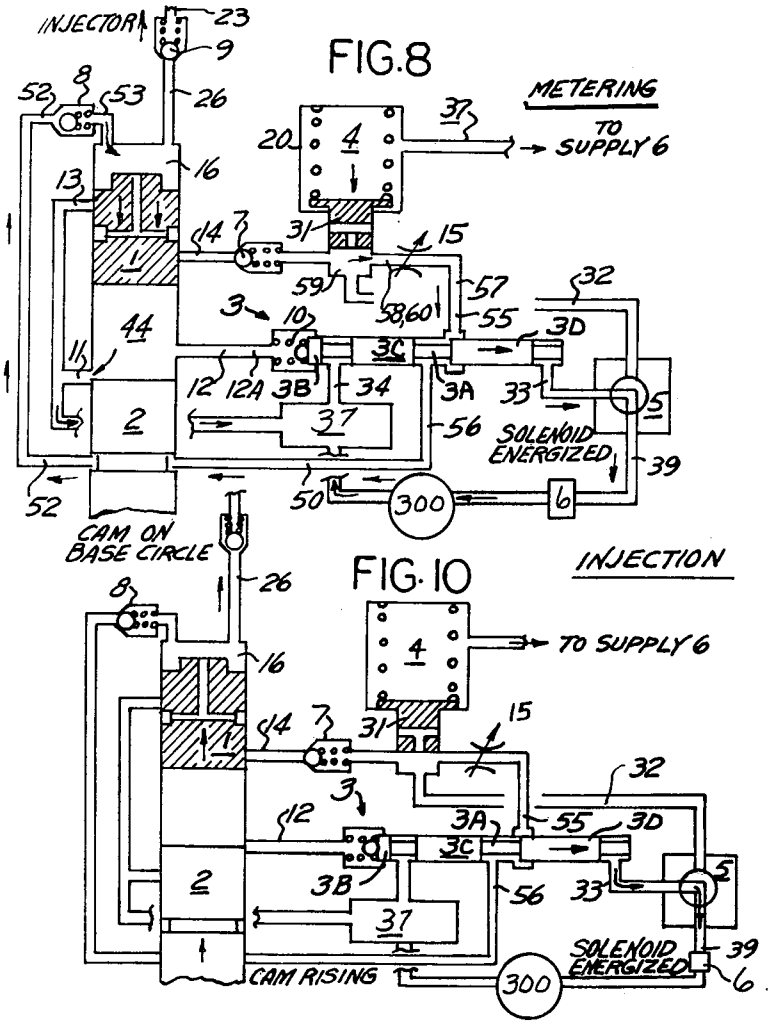
FIG.8
FIG.10

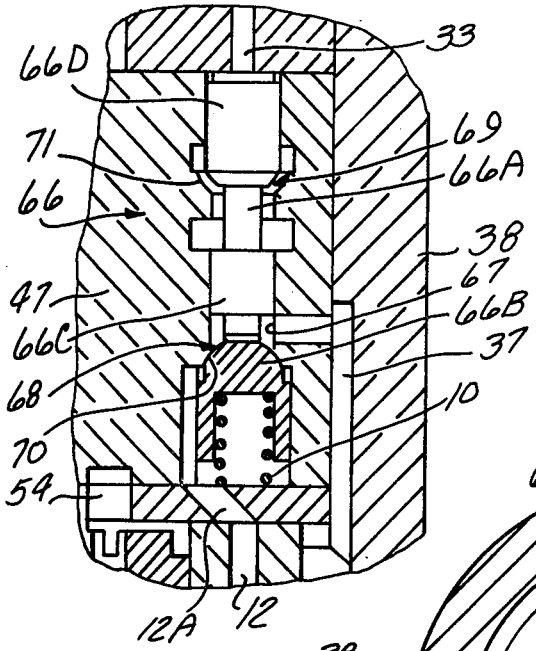
FIG-12
FIG-13
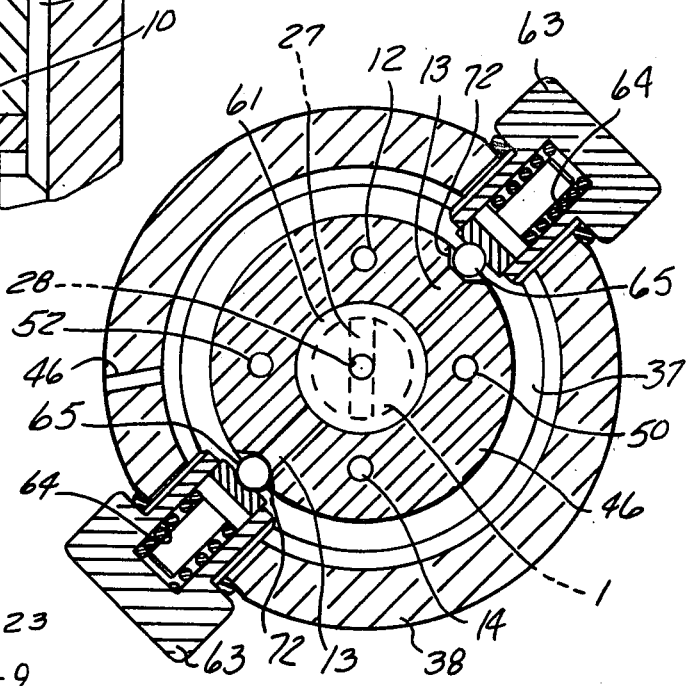
FIG-14
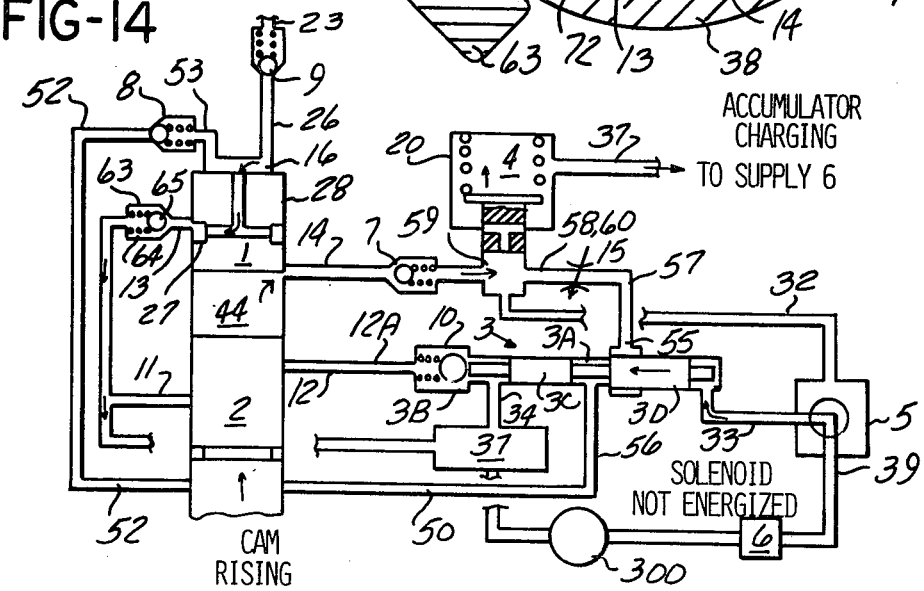

FUEL INJECTION PUMP

This application is a continuation-in-part of U.S. Application Ser. No. 276,608, filed June 28, 1981 now U.S. Pat. No. 4,422,424.

This invention relates generally to fuel injection pumps, and more particularly to electronically controlled, solenoid operated fuel injection pumps of the so-called jerk pump type adapted for use with diesel and internal combustion engines.

In applying an injection pump to an engine, the pump must fulfill requirements for capacity, injection duration, injection pressure, injection timing and in some cases control rack travel.

Jerk pumps commonly comprise a plunger disposed in an injection barrel which receives an amount of fuel to be pressurized. The plunger is mechanically driven by the engine as by a driving connection with an engine cam shaft so as to produce an injection of fuel at an appropriate point in the engine cycle by movement of the plunger in the barrel towards an injection chamber. The increased pressure in the injection chamber causes the opening of an injection delivery valve to thereby cause injection of the metered fuel charge into the associated engine cylinder.

In the jerk pump, both the quantity of fuel injected into the injection chamber for each injection cycle and also the timing of such fuel injection must be controlled. In the past it has been the practice to provide the plunger with a helical groove which cooperates with ports formed in the barrel to control the bypass of fuel from the injection chamber. In a traditional port-helix jerk pump, injection is terminated when the helix on the plunger uncovers a spill port in the barrel. When this occurs, depending upon the relative angular position of the helix to the spill port, the quantity of fuel to be delivered has been controlled. (See U.S. Pat. No. 2,922,581 issuing Jan. 26, 1960, and entitled "Fuel Injection Apparatus"). Means have also been provided for rotating the plunger to change the position of the helix within the barrel to produce a variation in bypass flow and hence in the quantity of fuel injection for a given injection cycle. For varying the timing, another helix is provided on top of the plunger which controls the beginning of injection.

This arrangement is realtively simple, reliable and has found widespread application. However, the limits within which the quantity and timing parameters of fuel injection may be varied by such grooves and ports are such that it is difficult to achieve precise control over these parameters for maximum engine efficiency and/or emission control.

In an effort to provide improved control over these parameters, arrangements for providing electrical control over the injection consisting of valving means and associated intensifiers which are operated wholly by electronic fuel control systems have been suggested. U.S. Pat. No. 4,219,154 issuing Aug. 28, 1980 and entitled "Electromagnetic Unit Fuel Injector" shows an electronically controlled fuel injection system which does not include an accumulator charged by a piston for supplying metered fuel.

In a jerk pump arrangement shown in U.S. Pat. No. 3,779,225 issuing Dec. 18, 1973 and entitled "Reciprocating Plunger Type Fuel Injection Pump having Electromagnetically Operated Control Port" leakage may be present in the control valving which affects the preciseness and efficiency of the injection process.

In one application an electronically controlled valve was provided to provide both injection and metering functions. This pump arrangement required very fast turnaround times of a solenoid and the valve when dealing with small fuel quantities. Also this pump did not deliver a metered fuel charge. It would be desirable to provide an injection system that delivers a metered fuel charge and which has an accumulator that supplies pressure without resorting to a separate pump. A built-in accumulator could supply fuel at sufficient pressure to make a servo-valve and control valve functional and also move a piston during metering.

SUMMARY OF THE INVENTION

The present invention overcomes the disadvantages stated with respect to the above referred to jerk pumps. A fuel injection pump comprises a floating piston adapted to control termination of high pressure fuel injection and a control valve which controls the beginning of the injection and the quantity to be injected. A multi-way pilot valve (servo-valve) determines the timing and quantity of fuel delivery through the control valve based on events in the engine cycle. As such, the subject pump provides for a fast response to engine needs, gives complete control over fuel quantities and injection timing not possible with aforesaid limitations of the plunger-helix geometry. The floating piston allows for metered fuel quantities. To do this, its motion must be independent of a plunger as determined by the state of the pilot valve. For injecting the metered fuel, motion of the piston must be dependent upon plunger but, again as determined by the state of the pilot valve. Pressurized fuel for the dual purpose of supplying metered fuel and servo-valve operation is generated within the pump by a reciprocating plunger and accumulator.

The jerk pump according to the subject invention utilizes spill ports to terminate injection and check valves coupled with the spill ports to prevent loss of metered fuel at the beginning of metering. Electronically controlled valving is utilized to control timing of injection and to control the metering of a quantity of fuel for each injection.

A metering adjustment screw can adjust the metered fuel quantity delivered to the metering chamber during a metering time period.

Advantages of the Present Invention

The present fuel injection pump can be electronically controlled with increased precision to overcome the shortcomings of the known fuel injection systems discussed above.

Another advantage of the present invention is the provision of means for calibrating the pump for use in supplying a predetermined quantity of fuel to a fuel injection system, the calibration being achieved by manually adjusting a variable orifice needle valve relative to a pump return flow passage.

Still another advantage of this invention is utilization of a pilot valve to determine fuel quantity to be delivered to an engine relative to a signal of fixed duration from an electronic controller.

Another advantage of the present invention is the provision of an electronically controlled solenoid operated fuel injection pump where the volume of fuel discharged to an engine during an injection phase is precisely and variably accumulated in a metering chamber during a preceding metering phase, the metered fuel subsequently being discharged by an injection piston.

Another advantage of the present invention is the provision of an electronically controlled means that is more reponsive and sensitive to changes in engine requirements.

Yet another advantage is provision of a pump having the ability to vary beginning of injection of any fuel delivery (quantity of fuel delivered) not capable by known port-helix type jerk pumps.

Other advantage attributable to the present fuel injection system will become apparent to the individual skilled in the art when the appended drawings are considered with the ensuing specification.

DESCRIPTION OF THE DRAWINGS

FIG. 2 is a partial section view taken along lines II—II of the pump of FIG. 1.

FIG. 3 is a partial section view taken along lines III—III of the pump of FIG. 1.

FIG. 4 is a transverse section view of the barrel in the pump taken along lines IV—IV of FIG. 3 showing spill ports.

FIG. 5 is a plan view, partially in section, of the pump of FIG. 1, showing a metering adjustment.

FIG. 8–11 are circuit diagrams of the fuel injection pump, the circuit diagram schematically representing respectively, metering, hold after metering, injection and accumulator charging modes.

FIG. 12 is a partial sectional view, taken on a larger scale, of the pump of FIG. 1 but depicting an alternate form of the control valve.

FIG. 13 is a transverse sectional view of the barrel in the pump similar to FIG. 4 but depicting optional check valves for the spill ports.

FIG. 14 is a circuit diagram of the pump schematically representing its accumulator charging mode and employing the check valves shown in FIG. 13.

DESCRIPTION OF THE INVENTION

Figure 1:
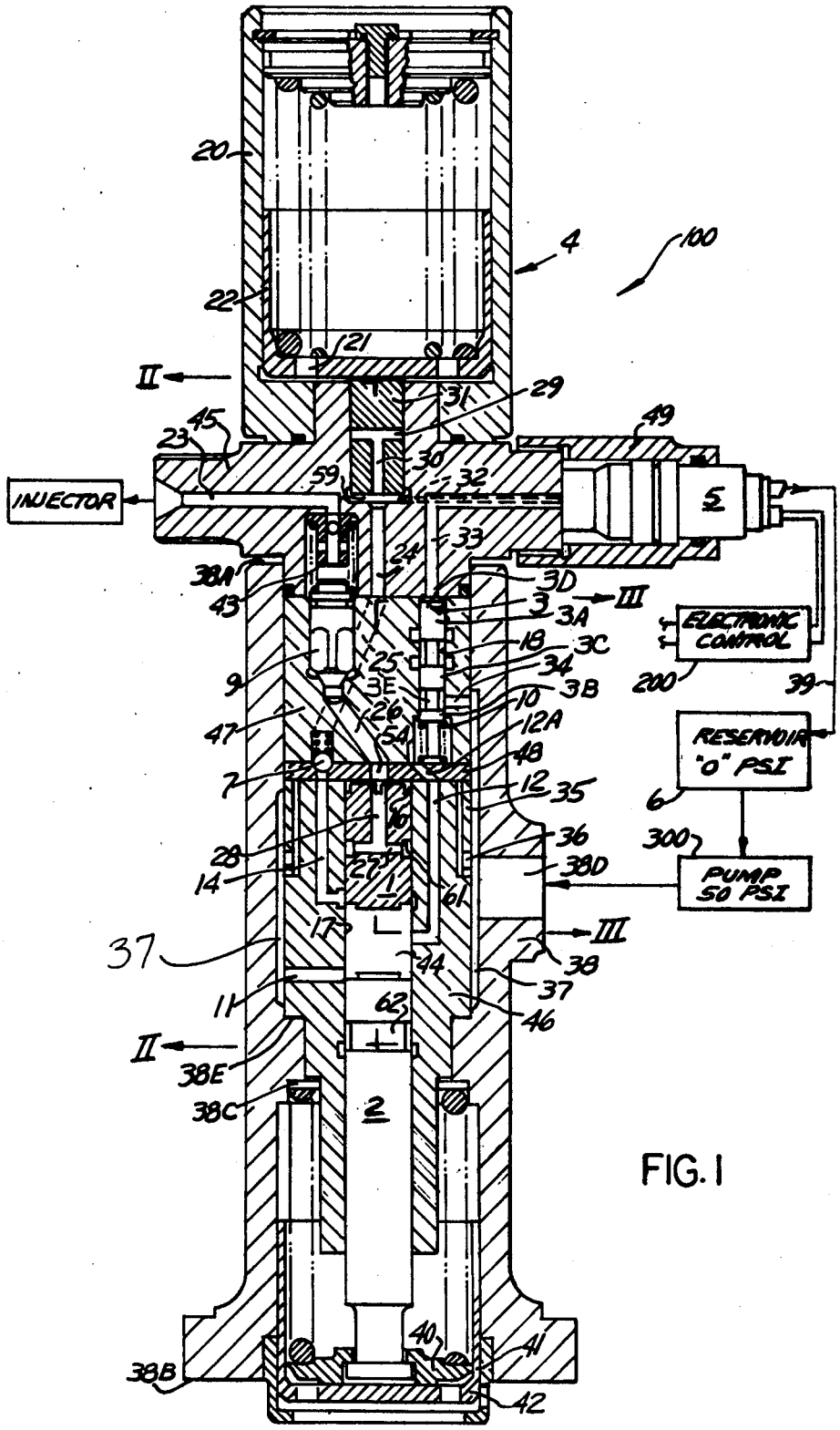
FIG. 1 is a view in section of a fuel injection pump according to the present invention.

Referring first to FIGS. 1–11 in the drawings, FIG. 1 shows a fuel injection pump 100 to be mounted on an engine (not shown) and adapted to be driven by a cam of the engine to inject high pressure fuel to the engine. The pump 100 includes a control valve 3 and a multi-way pilot valve 5 and utilizes a controller 200, the controller receving electronic signals from events of the engine operation and transmitting electronic signals to energize or de-energize the pilot valve 5 to time the states of flow for communicating fuel. The valves cooperate to determine fuel quantity to be delivered to the engine and the timing of the delivery. For injection pump operation, an auxiliary pump 300 supplies low pressure fuel from a reservoir 6 (e.g. a fuel tank).

The fuel injection pump 100 is comprised of several elements which are interfitted to form a housing assembly, none of which being novel in and of themselves. The housing assembly includes a pump housing 38 having top and bottom ends 38A, 38B, a hollow interior 38C extending between the ends and an inlet 38D for supplying low pressure fuel to the interior 38C, the bottom end 38B being adapted to mount to the engine. The interior 38C of the pump housing includes an annular groove 37 and an internal shoulder 38E for positioning a barrel 46 therein relative to the inlet and groove. Positioned in the housing interior and above barrel 46 are, respectively, a stop plate 48, a valve housing body 47 and the bottom portion of a delivery valve holder 45. The delivery valve holder 45 receives an accumulator 4 and a support sleeve 49 for housing the multi-way pilot valve 5.

Barrel 46 includes an internal bore defining a pumping chamber 17, the pumping chamber including at a top portion thereof a metering chamber 16 and at a bottom portion thereof a pressure chamber 44. The barrel further includes an inlet 11 communicating the pumping chamber with the annular groove, a passage 12 communicating the pumping chamber with the control valve 3 (i.e. a port receiving and discharging fuel), a spill port 13 (shown in FIGS. 2, 3 and 4) communicating metering chamber 16 with the annular groove 37, a passage 14 communicating the pumping chamber with the accumulator 4 and a pair of passages 50, 52 for communicating metered fuel from the accumulator to a metering inlet passage 53 (shown best in FIG. 3), passage 50 communicating fuel through the control valve 3 and into the pumping chamber to the metering passage. The metering chamber 16 of the barrel is arranged to communicate a metered amount of fuel through an outlet 26 and into an injection passage 23 leading to the engine.

A floating piston 1 is movably mounted in the pumping chamber 17, the piston dividing the pumping chamber into the upper metering chamber 16 and the lower pressure chamber 44, movement of the piston periodically uncovering a port leading to passage 14 during an accumulator charging phase and spill ports 13 terminating an injection phase. The piston 1 includes an annular groove 61, a vertical center passage 28 and a cross-passage 27 opening into annular groove 61, this groove and cross-passage 27 being brought into register with spill ports 13 upon upward movement of the piston.

A plunger 2 is connectably mounted to a cam mechanism to be driven or reciprocated within the pumping chamber 17 of barrel 46 in spaced apart relation to the piston 1. An annular groove 62 is disposed about the circumference of the plunger. Initially, annular groove 62 is in registration with the metering circuit passages 50, 52. Reciprocation of the plunger periodically moves groove 62 from registration with passages 50, 52 to close the passages 50, 52 and seal the pumping chamber from fuel being communicated thereacross by passage 50 from the control valve. Upward movement of plunger 2 forces the fuel upwardly and pressurizes the fuel in pressure chamber 44 to a predetermined pressure, the increase in fuel pressure in the pressure chamber to the predetermined pressure forcing the piston upward into the metering chamber 16 and causing the fuel therein also to be pressurized to the predetermined pressure.

Disposed at the bottom end of the barrel interior 38C is a spring cup 42 having a spring which biases against a spring plate 40 disposed about the plunger, the spring forcing the plunger 2 down as the cam lift diminished at the end of a cycle. The cam (not shown) is adapted to bias against the follower cup and drive the plunger upwardly.

Stop plate 48, positioned between barrel 46 and valve housing 47, defines a limit on upward travel for piston 1 and includes various apertures to direct flow therebetween and provides seats for first and second check valves 7, 8. An aperture 54 communicates fuel from the metering chamber to a high pressure passage disposed in the valve housing 47.

A delivery valve 9 is mounted in a cavity extending between the delivery valve holder 45 and the valve housing 47. The delivery valve 9 includes a delivery valve stop 43 and a spring normally biasing a valve body against a port communicating with injection passage 26 to define the closed position. The delivery valve opens only upon the attainment of a predetermined pressure which is sufficient to overcome the spring bias and force the valve body upwardly into an unseated position relative to outlet 26 from metering chamber 16. Delivery valve 9 when opened, communicates fuel from the metering chamber 16 via the passage 26, through passage 23 and into an injector (not shown) which feeds the high pressure fuel to the engine.

Accumulator 4 stores pressurized fuel at a first pressure and supplies pressurized fuel to pilot valve 5 to actuate control valve 3 and supply the metering circuit with sufficient fuel for a metering phase of pump operation. The accumulator serves to provide fuel to the pump 100 at an elevated pressure to the valves 3, 5 at all times, including through a supply circuit 58, 60, 57 during a charging phase via a passage 14. The accumulator includes an accumulator piston 31 movably disposed in a cavity formed in delivery valve holder 45, a housing 20 mounted to the delivery valve holder a spring cup 22 disposed in the housing and adapted to resist upward movement of the accumulator piston, a plurality of springs mounted within the housing and the holder 45.

The accumulator piston 31 includes a T-passage comprised of a cross-passage 29 intersected by a vertical central passage 20. A recess (cavity) 59 is formed in the cavity below the accumulator piston 31. In an accumulator charging phase, the cavity (and accumulator) receives fuel under pressure from pressure chamber 44, the fuel being communicated thereto via passage 14, and aperture in plate 48 leading to the first check valve 7, a diagonal passage 25 passing through the valve housing 47 and a vertical passage 4 in the delivery valve holder 45. In the accumulator charging phase, pressurized fuel from pressure chamber 44 forces accumulator piston 31 upwardly to a predetermined point determined by cross-passage 29. Accumulator filing ends when the cross passage 29 of the accumulator piston 31 is extended into the accumulator housing, the excess fuel from pressure chamber 44 being communicated to annular groove 37 via passage 51. Accumulator charging also accumulates a sufficient quantity of fuel in recess (cavity) 59 to be communicated to the metering chamber during the metering phase of the pump operation. During the metering phase, pilot valve 5 directs fuel through the control valve 3, the pumping chamber and into the metering chamber 16.

The pilot valve supply line 32 extends from the recess (cavity) 59 to the pilot valve 5 to operate the control valve 3. The accumulator periodically receives pressurized fuel from the pressure chamber 44 via the pressure port 14 and discharges pressurized fuel to the metering chamber via the metering passages 50, 52.

Electronic control means associates with the reciprocation of the plunger 2 controls timing of injection of the pressurized fuel, and includes actuation means for initiating fuel metering 3, 5 and means for terminating fuel injection 13, 27, 28.

The actuation means comprises pilot valve 5 communicating with inlet 32 for receiving high pressure fuel from the accumulator recess 59, an outlet 33 (i.e. inlet/-outlet drain) 33, a by-pass outlet 39 and an electromagnetically operated solenoid (400), the solenoid being selectively operable to provide a de-energized first state to communicate fluid between the inlet 32 and the outlet 33 during an accumulator pressurizing phase and a hold phase and an engerized second state to communicate fluid between the outlet 33 and the by-pass 39 during the metering phase and the injection phases.

The actuation means further comprises control valve 3 having a chamber 18, a spring 10 and a valve member 3A movable in the chamber 18 between first and second seated and unseated positions depending upon the state of the solenoid, the energized first state seating the valve member 3A and allowing accumulator fuel to communicate with the metering chamber and the de-energized second state allowing accumulator fuel to act against the valve member 3A, thus unseating such valve member such that the fuel communicates from pressure chamber 44 with the supply 6 via a port 34.

As shown in FIG. 1, valve member 3A may comprise a spool construction having three spaced spool portions 3B, 3C and 3D. Spool portions 3B, 3C and 3D are mounted on spool shaft 3E for movement with each other in spool chamber 18. The first spool part 3B is acted upon by spring 10 to block full communication between the pressure chamber 44 and the supply 6 as well as to seat the valve member. The second and third spool parts 3C and 3D act to respectively selectively cover or uncover ports of the chamber 18, depending on the state of pilot valve 5. Chamber 18 includes inlet ports 33, 55 and 12A and outlet ports 56 and 34, passage 12A communicating with pressure chamber port 12 and passage 56 communicating with metering chamber inlet 53. When the pilot valve is in the energized first state, spring 10 biases the spool into the seated position and the spool parts permit fuel to pass between ports 55 and 56 in the metering phase and low pressure fuel behind the spool to communicate via drain port 33 and passage 39 with the reservoir. When the pilot valve is in the de-energized second state, the spring 10 bias is not sufficient to resist high pressure fuel communicated to the spool from the accumulator via passages 32 and 33, thus the spool is unseated and fuel communication through passages 55, 56 cut off. However, passages 12, 12A are now able to communicate fuel between the pressure chamber 44 and annular groove 37.

The controller 200 receives a signal from the engine, based on engine events, and sends a signal to pilot valve 5, depending on the state of plunger 2. Pilot valve 5 generally feeds/bleeds fuel or pressurizes an area/depressurizes an area depending upon its two states.

Means for terminating fuel injection comprises T-shaped passage of the piston 1 being brought into register, as a result of upward movement of the piston, with the relief port 13 in the barrel 46. As a result of metering chamber 16 receiving fuel under pressure from the accumulator cavity 59, the piston is initially displaced downwardly in pumping chamber 17. Then, as plunger 2 moves upwardly in the pumping chamber, first closing off metering passages 50, 52 and passage 11. The fuel in pressure chamber 44 is captured and pressurized whenever passage 12 is closed off from passage 34 by the control valve 3 (i.e. energizing pilot valve 5 to the first state). Further increase in pressure in the pressure chamber exceeds the pressure of the metered fuel in metering chamber 16, causing cross-passages 27 to register with spill ports 13. This registering allows pressurized fuel in metering chamber 16 to bleed therefrom, lowering the pressure in the metering chamber below the predetermined pressure whereby the delivery valve 9 closes the injection port and injection terminated.

FIG. 2 shows the pump 100 partially in section. A relief passage 51 extends through the delivery valve holder 45 and valve housing 47 to supply to the annular groove 37.

Also shown is the second check valve 8 which comprises a spring normally biasing a ball into an apperture of stop plate 48 to close off fuel communication through passage 52 leaking to the metering passage 53, which in turn is supplied by metered fuel from passage 50 around plunger groove 62 through the chamber to passage 52 which overcomes the spring bias to supply the metered fuel through aperture 54 and to the metering chamber.

Floating piston 1 is shown with the annular groove 61 medial of its top and botton faces and disposed about cross passage 27.

Fuel from passage 14 (for accumulator filing) is communicated through a passage 25 in valve housing 47, through a passage 24 in the delivery valve holder 45 and into the accumulator pressure cavity (recess) 59. The accumulator piston 31 shown (in phantom) vertical passage 30 and cross passage 29.

FIG. 3 shown a fragmentary section of valve housing 47, stop plate 48 and the barrel 46, valve housing 47 having the accumulator relief passage 51. Inlet metering line 55 is shown communicating fuel from metering adjustment 15 to control valve 3 (shown in phantom). An outlet metering line 56 is shown communicating fuel from the spool valve to barrel passage 50.

FIG. 4 is a cross section of barrel 46 and clearly shows the piston 1 disposed in the pumping chamber, the barrel including transverse spill ports 13 to drain fuel from the annular groove 61 of the piston 1 as a result of the groove registering cross passage 27 therewith, metering circuit passages 50, 52, accumulator charging passage 14 and pressure chamber relief passage 12.

FIG. 5 shows a variable orifice 15 to adjust the rate at which the metered quantity of fuel is supplied from the accumulator 4 recess 59 to the metering chamber 16 during the time that a signal from controller 200 energized pilot valve 5. The variable orifice 15 comprises a metering adjustment screw 63 mounted to the delivery valve holder 45, screw 63 having a forward tapered portion adapted to seat in a tapered recess of the holder. When not seated, a separation 60 occurs therebetween to allow fuel to communicate between metering line 57 (communicating with the inlet metering line 55 to control valve 3) with a passage 58 leading to recess 59 in the accumulator. Rotation (opening of the screw 15) varies the flow rate at which pressurized fuel can pass from the recess 59 to the pilot valve.

Figure 6:
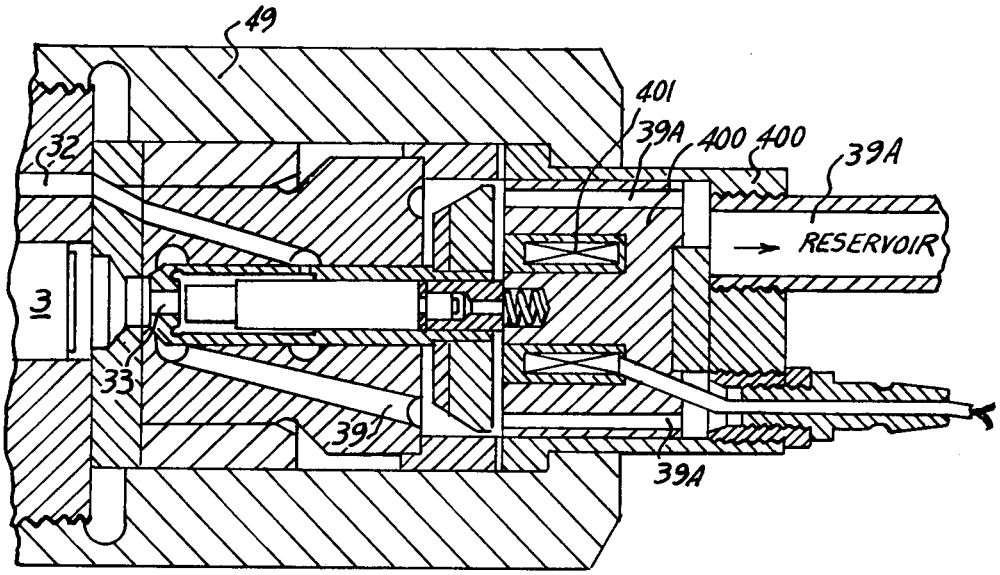
FIG. 6 is a section view of a pilot valve mounted to the pump of FIG. 1.

FIG. 6 shows a section view of the electromagnetic pilot valve 5. Although not novel in and of itself, the valve includes a solenoid 400 having a coil 401 which receives a signal from the controller 200 to activate a member to seat or unseat. A clear description is provied in the aforesaid U.S. Pat. No. 4,219,154. Valve member 3A is shown adjacent passage 33. Also shown are passages 32 and 39, passage 39 comprising passage portions 39A.

FIG. 12 depicts an alternate form of the control valve, generally indicated by the numeral 66, whose purpose and function are essentially identical to those of the control valve 3 previously described. Control valve 66 includes a valve member 66A which is slidable within valve chamber 67 defined within housing 47. Valve member 66A includes three valve portions 66B, 66C and 66D which operate in unison to open or close corresponding valve openings in housing 47. Valve portions 66B and 66D are respectively provided with arcuately shaped, annular shoulders 68, 69 which positively seat against correspondingly shaped seats 70, 71 defined in housing 47. In contrast to the construction of control valve 3 wherein valving action is determined by the relation between the sides of the valve chamber 18 and valve portions 3B, 3C, 3D which merely overlap and therefore allow some degree of fuel leakage causing metering in accuracies, the control valve 66 provides seating action which eliminates the possibility of fuel leakage.

FIG. 13 shows the optional use of a pair of check valves 63 in the spill ports 13, the purpose of which valves will be later explained. Check valves 63 are mounted in opposite sides of housing 38 and each include a compression spring 64 normally biasing a ball valve member 65 into sealing relationship with a valve seat 72 defined in spill ports 13. Check valves 63 function to check the flow of metered fuel from metering chamber 16 into annular groove 37 during the beginning of metering.

Operation

The operation of the fuel injection pump can be summarized with reference to the schematic FIGS. 7–11.

Figure 7:
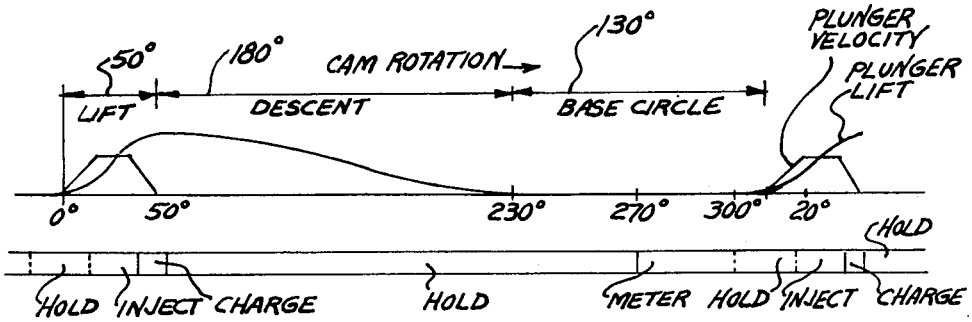
FIG. 7 is a schematic relating engine events, plunger movement and phases of the fuel injection.

FIG. 7 depicts rotation of the engine cam, lift of plunger (2) in the pumping chamber (17) and plunger velocity as a result of the cam rotation and the operational phases of the injection system. FIG. 7 assumes that the cam starts rotation at 0° with the plunger (2) being at its lowest point in the pumping chamber. Maximum plunger rise occurs at about 50° of cam rotation, the plunger returning to its lowest point at perhaps 230°. At a later time when the cam reaches 360° of rotation (i.e., returns to 0°), the plunger starts another rise (i.e., lift) and descent cycle.

Depending on the user's needs and/or application, the controller responds to messages from the engine to periodically energize the solenoid in pilot valve 5 to initiate metering and injection phases. At about 270°, the solenoid is energized and a metering phase begun. By varying the duration of this signal, the amount of fuel admitted to the metering chamber is varied, so that the quantity of fuel forced through the injector by the metering piston during the next injection phase is also varied. The time when each phase begins can also be varied. Perhaps at 300°, the solenoid is de-energized and a hold after metering phase initiated. Sometime after the cam reaches 360° (i.e., the cam returns to 0) the cam starts the plunger rising, during which the solenoid is again energized (perhaps at 20°) and an injection phase initiated. As the plunger continues to rise, the solenoid is de-energized (perhaps at 40°) and piston 1 is driven upwardly to uncover the low pressure spill port 13 and the injection phase is terminated. Shortly before piston 1 reaches its maximum rise in its metering chamber, port 14 is uncovered to communicate fuel to the accumulator, after which period an accumulator charging period continues until the plunger reaches maximum upward lift in the pumping chamber (i.e., at 50°). The plunger then descends to its lowest point (i.e., at 230) during which another hold period continues. The solenoid is again energized at 270° and the next metering phase begun.

FIG. 8 reflects the metering phase. For the purpose of describing a complete cycle, assume that the cycle begins when plunger 2 has descended to the cam base circle position. Sometime after plunger 2 has descended to the cam base circle position, pilot valve (3-way servo-valve) 5 is energized by a signal from a controlled electrical power source, causing the solenoid to close the pilot valve supply line 32, which communicates high pressure fuel from the accumulator 4 to the valve chamber 18, and causing passage 33 to communicate with passage 39. As a result of the pilot valve 5 being energized, the valve member (3A) of control valve 3 is driven to the seated position since the (drain) supply line 33 is subject to fuel pressure of lesser amount than the pressure exerted by the spring 10. Fuel from behind the valve member (3A) that is periodically under high pressure from the accumulator 4 when the servo-valve is in the de-energized state thereby bleeds back through passage 39 to reservoir 6 which is at substantially lower pressure.

Fuel under pressure from accumulator 4 flows through control valve 3, from an outlet metering line 56 through a passage 50 and about an annular groove 62 formed around plunger 2, outwardly and through passage 52 leading therefrom to second check valve 8 and into a region above piston 1 forming a metering chamber 16, forcing the piston 1 to move downwardly in the pressure chamber 44. A fixed amount of fuel trapped in recess 59 of the accumulator substantially provides the only fuel available for flow to meter chamber 16 above piston 1.

The fuel below piston 1 in the pressure chamber 44, being at a lower pressure, flows out through inlet port 1 immediately above plunger 2 and back to annular groove 37.

Second check valve 8 is closed at the end of metering (i.e., when the flow ceases).

As shown in FIG. 9, when the desired fuel quantity has been supplied to the metering chamber 16, based on a time flow, not dependent on the downward displacement of the floating piston 1, a signal is sent from the controller and pilot valve 5 is de-energized, whereby pressurized fuel from accumulator 4 is directed through supply lines 32 and 33 and back to the region in valve chamber 18 behind the control valve 3, thereby overcoming the force of spring 10 and moving valve member 3A into position where inlet metering line 55 is blocked from outlet metering line 56 thus ending further flow into metering chmber 16. Due to engine operation events, movement of the engine cam drives plunger 2 upwardly into the pressure chamber 44, blocking off metering passages 50, 52 and inlet port 11.

Further flow of metering fuel to metering chamber above floating piston 1 is blocked and fuel bleeding from the pressure chamber 44 through the inlet port 11 is stopped, metering of fuel ends and a hold after metering period commences. The hold after metering period is between the end of metering and beginning of injection when the metered charge is held inactive, and includes towards its end the initial rising of plunger 2 by the cam.

A metering adjustment member 15 includes a variable orifice 60 which compensates for tolerance variations between pumps so that each pump can meter the same quantity of fuel for the same time period that the pilot valve 5 is energized.

In the hold after metering mode, pilot valve 5 remains de-energized while the plunger 2 runs out on the cam base circle and begins to lift upwardly in the interior bore 17 of barrel 46. Metered fuel in metering chamber 16 is at a higher pressure than fuel captured in pressure chamber 44. Low pressure fuel in the chamber 44, displaced upwardly during the plunger's initial lift (since inlet port 11 has been blocked) is forced through passage 12 and control valve 3 and returns to annular groove 37.

FIG. 10 is the injection phase. At the desired moment in engine events, just after plunger 2 passes passage 11 but before it reaches passage 12, pilot valve 5 is energized and high pressure fuel from accumulator 4 is cutoff to line 33, simultaneously opening passage 33 to passage 39 and communicating fuel to the supply, thus lowering pressure acting on control valve 3 so that spring 10 biases the valve member 3A into the seated position (as it was in the beginning of metering). Plunger 2, which covered ports 50, 52 and inlet port 11, now pressurized fuel trapped above it in chamber 44 and forces floating piston 1 with its metered charge of fuel above it in metering chamber 16 to rise as well and be pressurized. When the plunger rises beyond the point at which the most retarded injection is required, passage 12 is closed off.

Delivery valve 9 to the injector is normally biased into a closed position. When the metered volume of fuel under pressure above floating piston 1 in the metering chamber 16 rises to a sufficiently higher pressure, the spring and any residual line pressure above delivery valve 9 is overcome to open the valve whereby the metered charge of fuel flows via passage 23 of the injector. Injection continues until the annular groove 61 around floating pistion 1 uncovers a spill port 13, registering piston passages 27 and 28 therewith, whereby the high pressure of fuel above floating piston 1 can pass through passage 28, cross-passage 27 and spill into supply 6 via spill port 13, registering piston passages 27 and 28 therewith, whereby the high pressure of fuel above floating piston 1 can pass through passage 28, cross-passage 27 and spill into annular groove 37 via spill port 13, thereby dropping the pressure rapidly in line 26 serving the injector, such that the bias spring in delivery 9 reseats, thus ending injection. Simultaneously or slightly later, the bottom of piston 1 uncovers accumulator fuel passage 14 and shortly thereafter, floating piston 1 abuts the top of internal bore 17 and can lift no further.

FIG. 11 represents this later condition and is an accumulator charging mode. Although floating piston 1 has stopped moving upwardly after injection, plunger 2 continues upward, displacing fuel above it though accumulator fuel passage 14 and first check valve 7. At some time prior to the end of injection, but after passage 12 is covered by the rising plunger 2, pilot valve 5 is de-energized, which unseats valve member 3A so as to block flow across it to outlet metering line 56 but allow flow through passage 34 to supply 6. Plunger 2 covers passage 12 as soon as possible after the passage is no longer needed to initiate injection (timing). This relieves the valve member 3A of its task of sealing off chamber 44 so that the solenoid can be de-energized, thereby saving power and reducing heat build up in its coil.

Fuel displaced through accumulator flow passage 14 and first check valve 7 is therefore forced into accumlator 4. When plunger 2 reaches the end of its stroke and displacement ceases, pressure equalizes in the check valve and the spring in first check valve 7 closes the valve, thereby trapping fuel sufficient for the next cycle.

Accumulator 4 bypasses excess fuel from the pressure chamber back to annular groove 37 via passage 51 after the accumulator piston reaches a certain height in the accumulator bore. This protects the accumulator from overstroking and ensures a uniform pressure and charge cycle to cycle.

FIG. 14 represents the end of injection and commencement of accumulator charging in the embodiment of the invention wherein the check valves 63 (FIG. 13) are employed in the spill ports 13. Check valves 63 are arranged so as to yield to the pressure of residual fuel in metering chamber 16 and allow such residual fuel to flow through spill ports 13 back to annular groove 37, thereby rapidly dropping the pressure in line 26 serving the injector. When the pressure in chamber 16 drops sufficiently, the check valves 63 close while passageway 27 remains registered with spill ports 13 for a brief period. At the commencement of the next metering cycle when check valve 8 opens, check valves 63 function to prevent the loss of metered fuel in metering chamber through spill ports 13.

While the preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

I claim:

1. In a fuel injection pump for supplying pressurized fuel to an engine, and of the type having a housing assembly provided with an internal bore defining a pressure chamber having an inlet/outlet port for receiving and discharging fuel and a metering chamber having an inlet for receiving a metered quantity of fuel and an outlet for discharging pressurized fuel, a plunger connectably driven by the engine for reciprocation in the pressure chamber, a floating piston movably disposed within said bore in spaced relation to the plunger, a control valve chamber located within said housing assembly and having a first port communicating with the pressure chamber port a second port communicating with the metering chamber inlet and a drain outlet, a valve member movable within the control valve chamber between seated and unseated positions, an accumulator pressurized by reciprocation of the plunger to provide high pressure fuel to the pump, the accumulator providing fuel to the control valve chamber and to the metering chamber and having a recess for receiving a sufficient amount of pressurized fuel, a pilot valve adapted to be energized and de-engergized to selectively establish first and second states of flow for communicating fuel between the accumulator and the control valve chamber the energized state causing the valve member to be seated and the deenergized state causing the valve member to be unseated, a normally closed delivery valve operable by a predetermined pressure to open and communicate the metered quantity of fuel in the metering chamber through the outlet to the engine, the communication of the metered quantity of fuel representing an injection phase of the pump operation, means for terminating the injection phase as a result of piston being displaced upwardly in the bore, said termination means including a spill port in said housing assembly communicating with an annular groove in said housing and passages in said piston communicating with metering chamber such that when piston is driven upwardly, the passages communicate with spill port and communicate fuel from the metering chamber to the spill port whereupon the predetermined pressure in metering chamber falls and delivery valve closes, thereby terminating injection of fuel to the engine, the improvement characterized by:

a normally closed check valve communicating with said spill port and operable by a predetermined pressure to open and allow escape of residual fuel from said metering chamber following said injection phase.

2. A fuel injection pump as required by claim 1, wherein said check valve is connected between said spill port and said annular groove.

3. A fuel injection pump as required by claim 1, wherein said housing assembly includes a second spill port communicating with said annular groove and there is further provided a second normally closed check valve communicating with said spill port, said second check valve operable by a predetermined pressure to open and allow escape of residual fuel from said metering chamber following said injection phase.

4. A fuel injection pump as required by claim 1 wherein the improvement is further characterized by a plurality of valve seats and a plurality of valve portions defining said valve member, said valve portions positively seating respectively against said valve seats to prevent fuel leakage through said valve member.

5. In a fuel injection pump for use with an engine, the pump being of the type including a housing provided with an internal bore defining a fuel metering chamber means communicating with the bore for receiving low pressure fuel, a plunger connectably mounted to the engine for reciprocation in the bore to pressurize fuel received therein, means for discharging pressurized fuel to the engine, a pilot valve located within the housing and selectively operable between an energized first state and a de-energized second state, an accumulator for storing pressurized fuel, said accumulator communicating with the internal bore for receiving pressurized fuel therefrom by reciprocation of the plunger means for terminating fuel injection to the engine, and means for initiating fuel injection to the engine, said initiating means including a control valve having a valve member movably mounted within a control valve chamber the valve member being mounted for reciprocation between a seated position when pilot valve is de-energized, the seated position communicating fuel to be metered from the accumulator to the metering chamber and controlling the start of injection of fuel, said accumulator supplying pressurized fuel to metering chamber through the control valve when the pilot valve is energized, the improvement comprising:

a pair of valve seats in said control valve chamber and a pair of valve portions defining said valve member and respectively positively seating against said valve seats to prevent fuel leakage through said control valve.

6. In a fuel injection pump for supplying pressurized fuel to an engine, and of the type including the combination of a housing assembly having an internal bore defining a pressure chamber having an inlet for receiving fuel at a first pressure and a metering chamber having a metering inlet for introducing a metered quantity of fuel into the metering chamber and an outlet for communicating fuel to the engine, plunger means for periodically pressurizing the fuel in the pressure chamber to a higher second pressure, piston means movably disposed in the bore in spaced-apart working relation with the plunger means for allowing the metering chamber to fill with a metered quantity of fuel at a third pressure and for expelling the metered quantity of fuel therefrom at the second pressure, delivery valve means for closing said outlet until said second pressure is attained in the metering chamber, attainment of the second pressure communicating the metered fuel to the engine, means for initiating fuel injection, and means for terminating fuel injection including a spill port placing said metering chamber in communication with an annular groove, the spill port communicating with the metering inlet through the metering chamber when fuel is being introduced into said metering chamber at said third pressure, the improvement comprising:

a normally closed check valve coupled between said spill port and said annular groove for normally preventing flow of metered fuel from said metering chamber to said annular groove when fuel is being introduced at said third pressure into said metering chamber, said check valve being responsive to a predetermined pressure in said metering chamber higher than said third pressure to open for allowing flow of fuel in said metering chamber to said annular groove.

* * * * *